US008111218B2

(12) United States Patent
Choi

(10) Patent No.: US 8,111,218 B2
(45) Date of Patent: Feb. 7, 2012

(54) PIXEL, ORGANIC LIGHT EMITTING DISPLAY USING THE SAME, AND DRIVING METHOD THEREOF

(75) Inventor: Sang-moo Choi, Suwon-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 1010 days.

(21) Appl. No.: 12/073,209

(22) Filed: Mar. 3, 2008

(65) Prior Publication Data

US 2008/0211397 A1 Sep. 4, 2008

(30) Foreign Application Priority Data

Mar. 2, 2007 (KR) ..... 10-2007-0020855

(51) Int. Cl.
*G09G 3/30* (2006.01)

(52) U.S. Cl. ..... 345/76; 345/82

(58) Field of Classification Search ..... 345/82
See application file for complete search history.

(56) References Cited

U.S. PATENT DOCUMENTS

| | | | | |
|---|---|---|---|---|
| 7,365,742 | B2 | 4/2008 | Kim et al. | |
| 7,414,599 | B2 | 8/2008 | Chung et al. | |
| 2005/0017934 | A1* | 1/2005 | Chung et al. | 345/82 |
| 2005/0140600 | A1 | 6/2005 | Kim et al. | |
| 2005/0269958 | A1 | 12/2005 | Choi et al. | |
| 2005/0280614 | A1 | 12/2005 | Goh | |
| 2006/0103324 | A1 | 5/2006 | Kim et al. | |
| 2006/0253755 | A1* | 11/2006 | Wu | 714/726 |

FOREIGN PATENT DOCUMENTS

| | | | |
|---|---|---|---|
| JP | 2006-011435 | | 1/2006 |
| KR | 10-2003-0081919 | A | 10/2003 |
| KR | 10-2005-0005646 | A | 1/2005 |
| KR | 10-2005-0051300 | A | 6/2005 |
| KR | 10-2005-0098485 | A | 10/2005 |
| KR | 10-2005-0110961 | A | 11/2005 |
| KR | 10-2005-0121379 | A | 12/2005 |
| KR | 10-2006-0054603 | A | 5/2006 |

* cited by examiner

*Primary Examiner* — Sumati Lefkowitz
*Assistant Examiner* — Ieesha Gillis
(74) *Attorney, Agent, or Firm* — Lee & Morse, P.C.

(57) ABSTRACT

A pixel, an organic light emitting display using the pixel, and a driving method thereof may compensate for degradation of an organic light emitting diode. The pixel includes the organic light emitting diode and a drive transistor that supplies an electric current to the organic light emitting diode. A pixel circuit compensates a threshold voltage of the drive transistor. A compensator controls the voltage of the gate electrode of the drive transistor in order to compensate a degradation of the organic light emitting diode.

17 Claims, 10 Drawing Sheets

PIXEL, ORGANIC LIGHT EMITTING DISPLAY USING THE SAME, AND DRIVING METHOD THEREOF

BACKGROUND OF THE INVENTION

1. Field of the Invention

Embodiments relate to a pixel, an organic light emitting display using the pixel, and a driving method thereof. More particularly, embodiments relate to a pixel capable of compensating for reduced luminance of an organic light emitting diode, an organic light emitting display using the pixel, and a driving method thereof.

2. Description of the Related Art

In general, flat panel displays, e.g., a liquid crystal display (LCD), a field emission display (FED), a plasma display panel (PDP), an electroluminescent (EL) display, and so forth, may have reduced weight and volume as compared to a cathode ray tube (CRT) display. For example, the EL display, e.g., an organic light emitting display, may include a plurality of pixels, and each pixel may have an organic light emitting diode (OLED). Each OLED may include a light emitting layer emitting red (R), green (G), or blue (B) light triggered by combining of electrons and holes therein, so the pixel may emit corresponding light to form images. Such an EL display may have a rapid response time and low power consumption.

The conventional pixel of the EL display may be driven by a driving circuit configured to receive data and scan signals and to control light emission from its OLED with respect to the data signals. More specifically, an anode of the OLED may be coupled to the driving circuit and a first power source, and a cathode of the OLED may be coupled to a second power source. Accordingly, the OLED may generate light having a predetermined luminance with respect to current flowing therethrough, while the current may be controlled by the driving circuit according to the data signal.

However, the material of the light emitting layer of the conventional OLED, e.g., organic material, may deteriorate over time as a result of, e.g., contact with moisture, oxygen, and so forth, thereby reducing current/voltage characteristics of the OLED and, consequently, deteriorating luminance of the OLED. Further, each conventional OLED may deteriorate at a different rate with respect to a composition of its light emitting layer, i.e., type of material used to emit different colors of light, thereby causing non-uniform luminance. Inadequate luminance, i.e., deteriorated and/or non-uniform luminance, of the OLEDs may decrease display characteristics of the EL display device, and may reduce its lifespan and efficiency.

SUMMARY OF THE INVENTION

Embodiments of the present invention are therefore directed to a pixel, an organic light emitting display including the same, and a driving method thereof, which substantially overcome one or more of the problems due to the limitations and disadvantages of the related art.

It is therefore a feature of an embodiment of the present invention to provide a pixel with a compensator capable of compensating for inadequate luminance of an organic light emitting diode, a display including the same, and a driving method thereof.

At least one of the above and other features of the present invention may be realized by providing a pixel including an organic light emitting diode, a drive transistor configured to supply an electric current to the organic light emitting diode, a pixel circuit configured to compensate a threshold voltage of the drive transistor, and a compensator for controlling the voltage of the gate electrode of the drive transistor in order to compensate a degradation of the organic light emitting diode.

The compensator may include a pair of transistors coupled between the voltage source and an anode electrode of the organic light emitting diode, and a feedback capacitor coupled between a common node of the pair of transistors and the gate electrode of the drive transistor. The pair of transistors may be alternately turned-on/off. A voltage of the voltage source may be higher or lower than the threshold voltage of the organic light emitting diode.

At least one of the above and other features of the present invention may be realized by providing an organic light emitting display, including a scan driver configured to drive scan lines, a data driver configured to drive data lines, and pixels coupled with the scan lines and the data lines. Each of the pixels may include an organic light emitting diode, a drive transistor configured to supply an electric current to the organic light emitting diode, a pixel circuit configured to compensate a threshold voltage of the drive transistor, and a compensator configured to control the voltage of the gate electrode of the drive transistor in order to compensate a degradation of the organic light emitting diode.

At least one of the above and other features of the present invention may be realized by providing a method for driving an organic light emitting display, including diode-connecting a drive transistor when a low scan signal is supplied to charge a storage capacitor with a voltage corresponding to a data signal and a threshold voltage of the drive transistor, maintaining one terminal of a feedback capacitor the threshold voltage of the organic light emitting diode during while the storage capacitor is charged with the voltage, another terminal of the feedback capacitor being coupled with the gate electrode of the drive transistor, and changing the one terminal of the feedback capacitor to a voltage of a voltage source after the storage capacitor is charged with the voltage.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
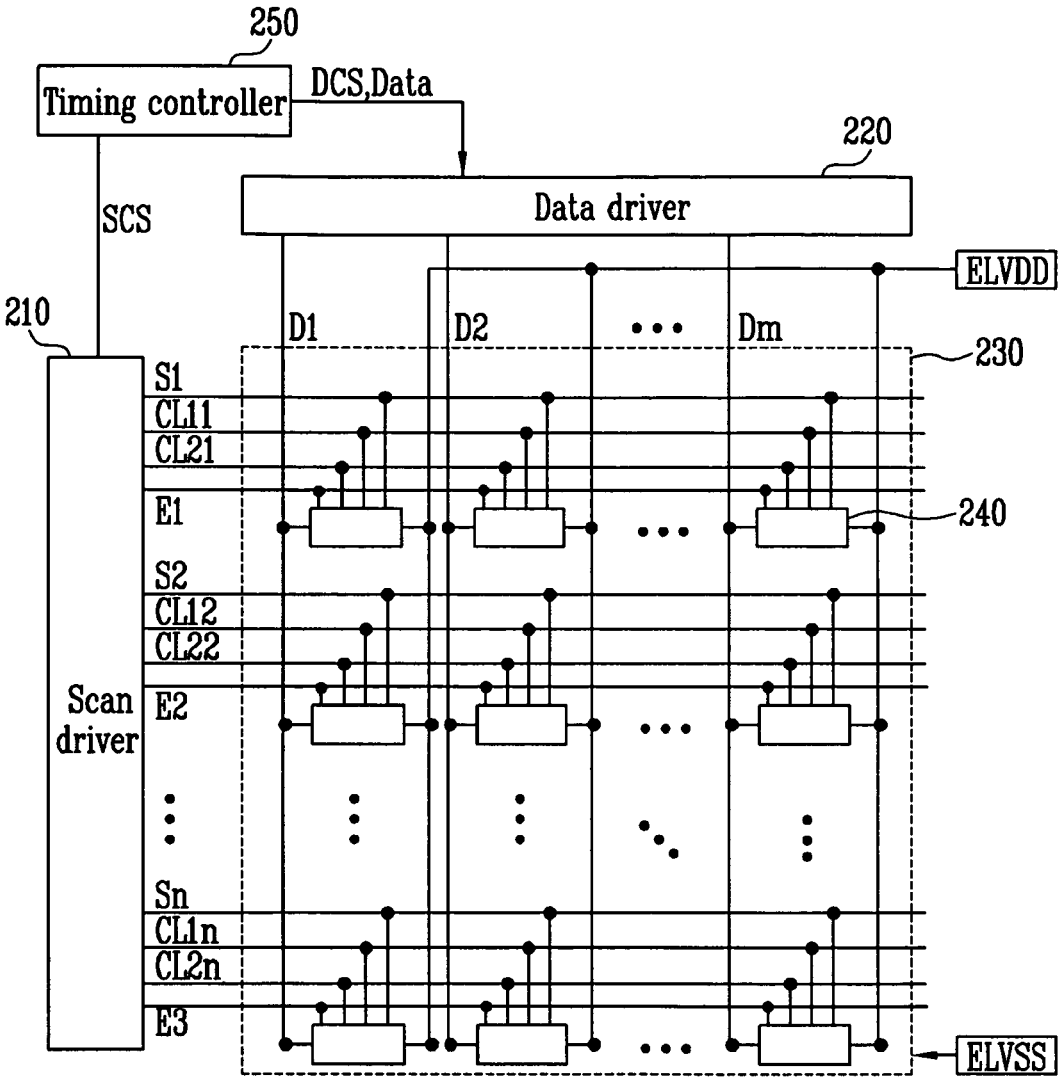
FIG. 1 illustrates a schematic view of an organic light emitting display according to an embodiment of the present invention.

Korean Patent Application No. 10-2007-0020855, filed on Mar. 2, 2007, in the Korean Intellectual Property Office, and entitled: "Pixel, Organic Light Emitting Display Using the Same, and Driving Method Thereof," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

It will also be understood that, although the terms "first," "second," etc., may be used herein to describe various elements, such elements should not be limited by these terms. These terms are only used to distinguish an element from other elements. Thus, a first element discussed herein could be termed a second element, etc., without departing from the teachings of example embodiments.

Hereinafter, embodiments according to the present invention will be described with reference to the accompanying drawings, namely, FIG. 1 to FIG. 11. Here, when one element is connected to another element, one element may be not only directly connected to another element but also indirectly connected to another element via another element. Further, irrelevant elements maybe omitted for clarity. Also, like reference numerals refer to like elements throughout.

FIG. 1 illustrates an organic light emitting display according to an embodiment of the present invention. With reference to FIG. 1, the organic light emitting display according to an embodiment of the present invention may include a pixel portion 230, a scan driver 210, a data driver 220, and a timing controller 250.

The pixel portion 230 may include a plurality of pixels 240, which are coupled with scan lines S1 to Sn, first control lines CL11 to CL1*n*, second control lines CL21 to CL2*n*, emission control lines E1 to En, and data lines D1 to Dm. The scan driver 210 may drive the scan lines S1 to Sn, first control lines CL11 to CL1*n*, second control lines CL21 to CL2*n*, and the emission control lines E1 to En. The data driver 220 may drive the data lines D1 to Dm. The timing controller 250 may control the scan driver 210 and the data driver 220.

The scan driver 210 may receive a scan driving control signal SCS from the timing controller 250. The scan driver 210 that receives the scan driving control signal SCS may sequentially generate and provide a scan signal to the scan lines S1 through Sn. Further, the scan driver 210 may generate a first control signal and a second control signal in response to the scan driving control signal SCS, sequentially provide the first control signal to the first control lines CL11 to CL1*n*, and sequentially provide the second control signal to the second control lines CL21 to CL2*n*. Moreover, the scan driver 210 may sequentially generate and provide an emission control signal to the emission control lines E1 to En.

The emission control signal may have a greater width than that of the scan signal. In practice, a high emission control signal may be supplied to an i-th emission control line to overlap a low scan signal supplied to the (i−1)-th scan line and the i-th scan line. Further, a high first control signal and a low second control signal supplied from the first and second i-th control lines, respectively, may overlap a high emission control signal supplied to the i-th emission control line.

The data driver 220 may receive a data driving signal DCS from the timing controller 250. When the data driver 220 receives the data driving signal DCS, the data driver 220 may generate and provide a data signal Data to the data lines D1 through Dm.

The timing controller 250 may generate a data driving signal DCS and a scan driving signal SCS corresponding to synchronization signals supplied from an exterior. The data driving signal DCS generated by the timing controller 250 may be provided to the data driver 220, and the scan driving signal SCS may be provided to the scan driver 210. Further, the timing controller 250 may provide an externally supplied data signal Data to the data driver 220.

The pixel portion 230 may be coupled to a first power source ELVDD and a second power source ELVSS, both of which may be external to the pixel portion 230. Thus, voltages of each of the first and second power supplies ELVDD and ELVSS may be supplied to each of the pixels 240. Accordingly, each of the pixels 240 receiving voltage from the first and second power sources (ELVDD) and (ELVSS) may generate light in accordance with the data signal Data supplied thereto.

The pixels 240 may compensate for degradation of organic light emitting diode (OLEDs) and threshold voltages of drive transistors included therein to generate light of desired luminance. To do this, each of the pixels 240 may include a compensator (not shown in FIG. 1, but discussed in detail below) for compensating the degradation of the OLEDs and the threshold voltage of the drive transistor.

So as to compensate the threshold voltage of the drive transistor, a pixel 240 positioned at an i-th horizontal line may be coupled to an i-th scan line Si and an (i−1)-th scan line Si−1. Thus, a zero-th scan line S0 may be further installed preceding the first scan line S1.

Figure 2:
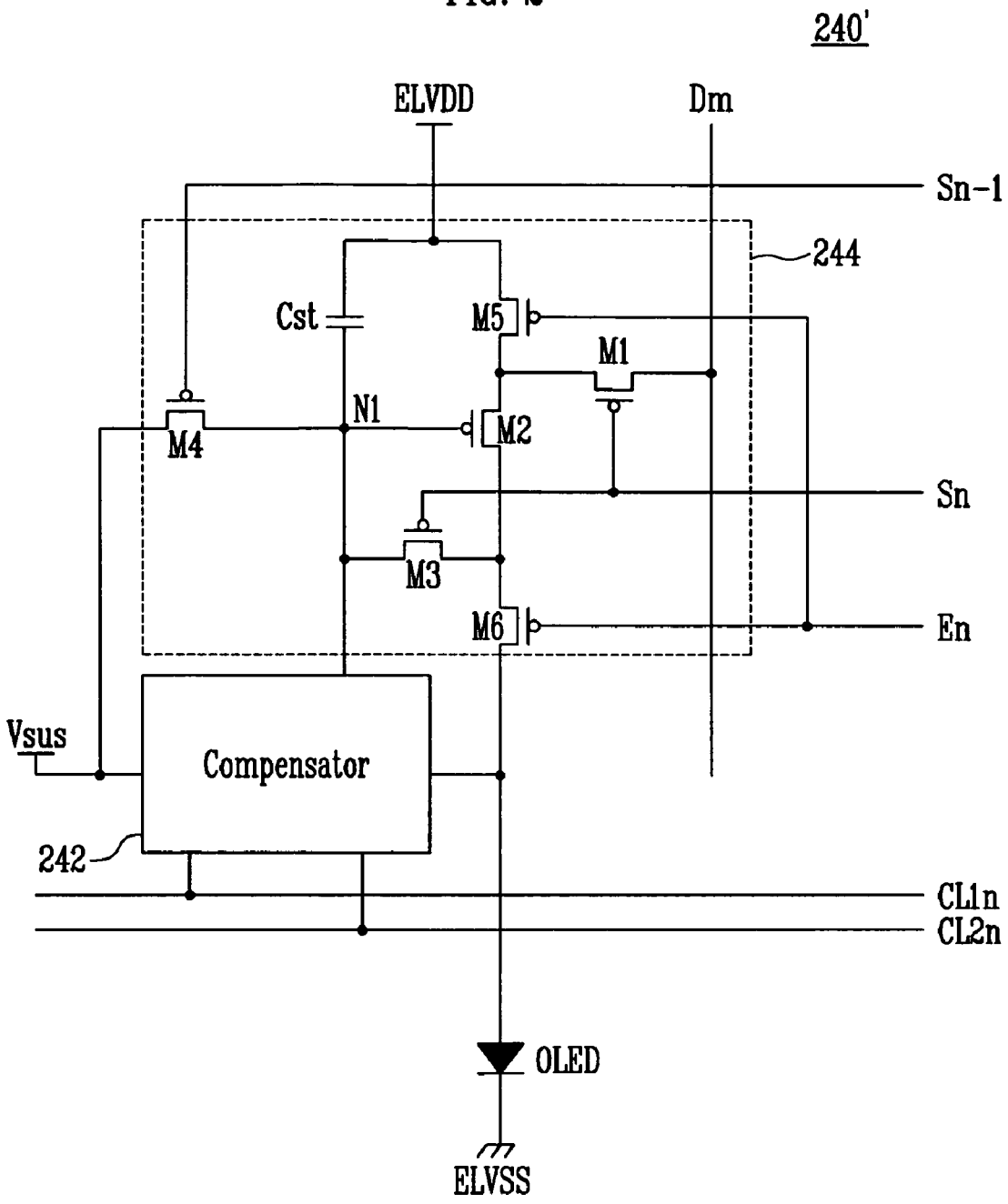
FIG. 2 illustrates a circuit diagram of an embodiment of the pixel shown in FIG. 1.

FIG. 2 illustrates a circuit diagram of a pixel 240' that may be used as the pixel 240 shown in FIG. 1 according to an embodiment. For convenience of a description, FIG. 2 illustrates the pixel 240' coupled to an n-th scan line Sn and an m-th data line Dm.

With reference to FIG. 2, the pixel 240' may include an OLED, a pixel circuit 244, and a compensator 242. The pixel circuit 244 may include first through sixth transistors M1 to M6 and a storage capacitor Cst. Second transistor M2 may function as a drive transistor. The pixel circuit 244 may compensate a threshold voltage of the second transistor M2. The compensator 242 may compensate for degradation of the OLED. The pixel circuit 244 may control an amount of an electric current supplied to the OLED.

An anode electrode of the OLED may be coupled to the pixel circuit 244, and a cathode electrode thereof may be coupled to the second power source ELVSS. The OLED may generate light having predetermined luminance corresponding to an electric current supplied from the second transistor (namely, drive transistor) M2 via the sixth transistor M6. The first power source ELVDD may have a voltage higher than that of the second power source ELVSS.

The first transistor M1 may be coupled to the scan line Sn and the data line Dm. The second transistor (or drive transistor) may control an amount of an electric current supplied to the OLED. The third transistor M3 may diode-connect the second transistor M2. The fourth transistor M4 may be coupled between a gate electrode of the second transistor M2 and a voltage source Vsus. The fifth transistor M5 may be coupled between the second transistor M2 and the first power source ELVDD. The sixth transistor M6 may be coupled between the second transistor M2 and the OLED.

The first transistor M1 may have a gate electrode coupled to the scan line Sn, a first electrode coupled to a data line Dm, and a second electrode coupled to a first electrode of the second transistor M2. When a low scan signal is supplied to the scan line Sn, the first transistor M1 is turned-on to transfer the data signal Data supplied to the data line Dm to the first electrode of the second transistor M2.

The second transistor M2 may have a gate electrode coupled to a first node N1, the first electrode coupled to the second electrode of the first transistor M1, and a second electrode coupled to a first electrode of the sixth transistor M6. The second transistor M2 having a construction described above supplies an electric current corresponding to a voltage applied to the first node.

The third transistor M3 may have a first electrode coupled to the second electrode of the second transistor M2, a second electrode coupled to the first node N1, and a gate electrode coupled to the scan line Sn. When a low scan signal is supplied to the n-th scan line Sn−1, the third transistor M3 is turned on to diode-connect the second transistor M2.

The fourth transistor M4 may have a first electrode coupled to the first node N1, a second electrode coupled to the voltage source Vsus, and a gate electrode coupled to the (n−1)-th scan line Sn−1. When a low scan signal is supplied to the (n−1)-th scan line Sn−1, the fourth transistor M4 is turned on to initialize a voltage of the first node N1 with a voltage of the voltage source Vsus.

The fifth transistor M5 may have a first electrode coupled to the first power source ELVDD, a first electrode coupled to the first electrode of the second transistor M2, and a gate electrode coupled to the emission control line En. When a low emission control signal is supplied to the emission control line En, the fifth transistor M5 is turned-on to connect the second transistor M2 to the first power source ELVDD.

The first electrode of the sixth transistor M6 may be coupled to the second electrode of the second transistor M2, a second electrode coupled to the OLED, and a gate electrode of the sixth transistor M6 may be coupled to the emission control line En. When a low emission control signal is supplied to the emission control line En, the sixth transistor M6 is turned-on to connect the second transistor M2 with the OLED.

The compensator 242 may control a voltage in the gate electrode of the second transistor M2, namely, a voltage of the first node N1, corresponding to a degradation of the OLED. Accordingly, the compensator 242 may be coupled with the voltage source Vsus, the first control line CL1*n*, and the second control line CL2*n*. The compensator 242 may control the voltage of the first node N1 corresponding to the degradation of the OLED. The voltage of the voltage source Vsus may be set to a voltage lower than a voltage Voled of the OLED. The voltage Voled of the OLED may be set to a voltage applied to the OLED, e.g., a threshold voltage of the OLED. The voltage Voled of the OLED may change in accordance with degradation of the OLED. In practice, as the OLED degrades, the threshold voltage of the OLED is increased.

Figure 3:
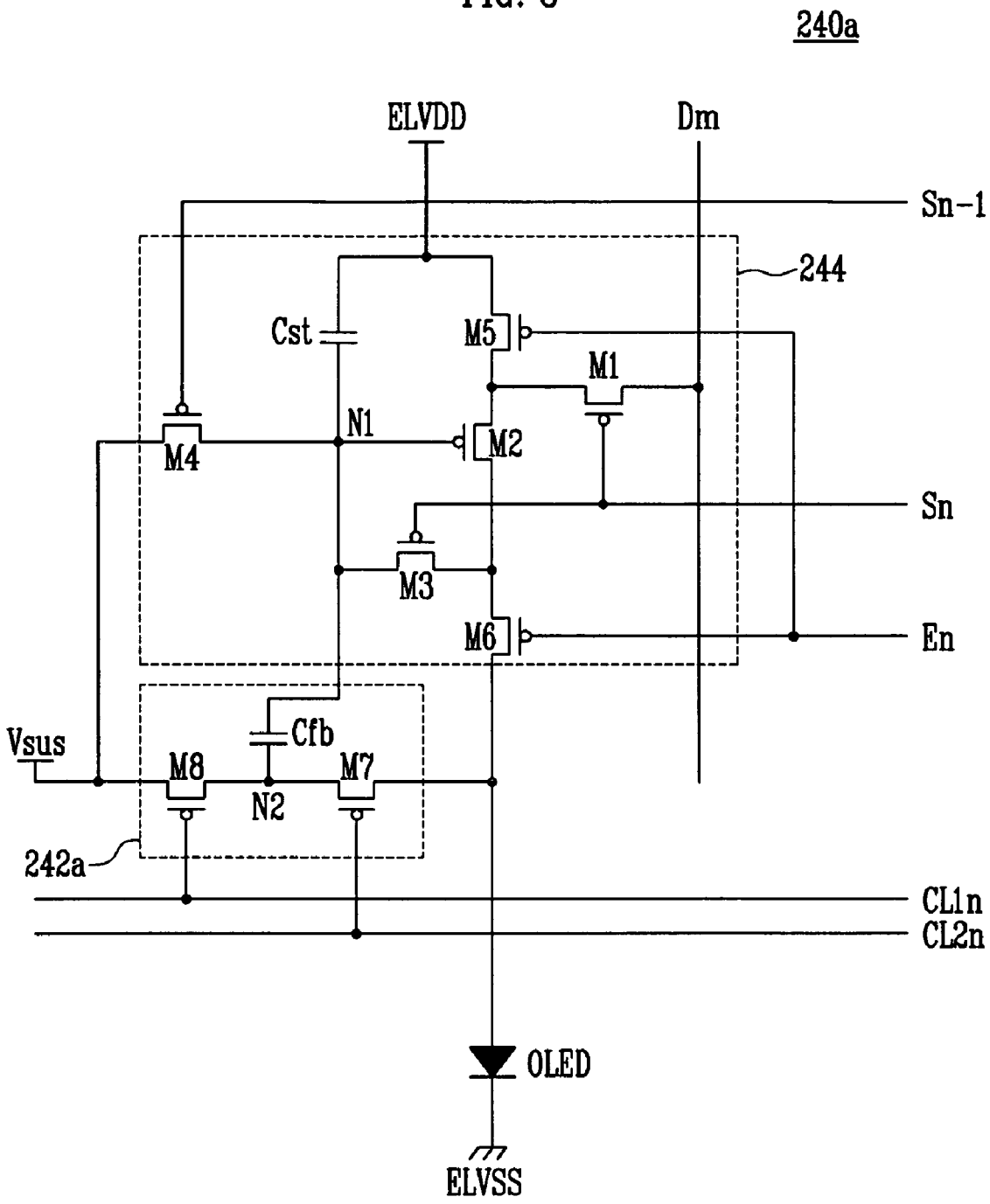
FIG. 3 illustrates a detailed circuit diagram of the compensator shown in FIG. 2 according to an embodiment.

FIG. 3 illustrates a circuit view of a pixel 240*a* including a compensator 242*a* in accordance with an embodiment for use as the pixel 240' shown in FIG. 2.

With reference to FIG. 3, the compensator 242*a* may include a seventh transistor M7, an eighth transistor M8, and a feedback capacitor Cfb. The seventh transistor M7 and the eighth transistor M8 may be coupled between the voltage source Vsus and the anode electrode of the OLED. The feedback capacitor Cfb may be coupled between the first node N1 and a second node N2, which is a node common to the seventh transistor M7 and the eighth transistor M8.

The seventh transistor M7 may be coupled between the second node N2 and the OLED. The seventh transistor M7 may be controlled by a second control signal supplied to the second control line CL2*n*. For example, when a low second control signal is supplied to the seventh transistor M7, the seventh transistor M7 is turned-on. Otherwise, the seventh transistor M7 is turned-off.

The eighth transistor M8 may be coupled between the second node N2 and the voltage source Vsus. The eighth transistor M8 may be controlled by a first control signal supplied to the first control line CL21. For example, when a low first control signal is supplied to the eighth transistor M8, the eighth transistor M8 is turned-on. Otherwise, the eighth transistor M8 is turned-off.

The seventh transistor M7 and the eighth transistor M8 may be alternately turned-on/off. The feedback capacitor Cfb may transfer a voltage drop of the second node N2 to the first node N1.

Figure 4:
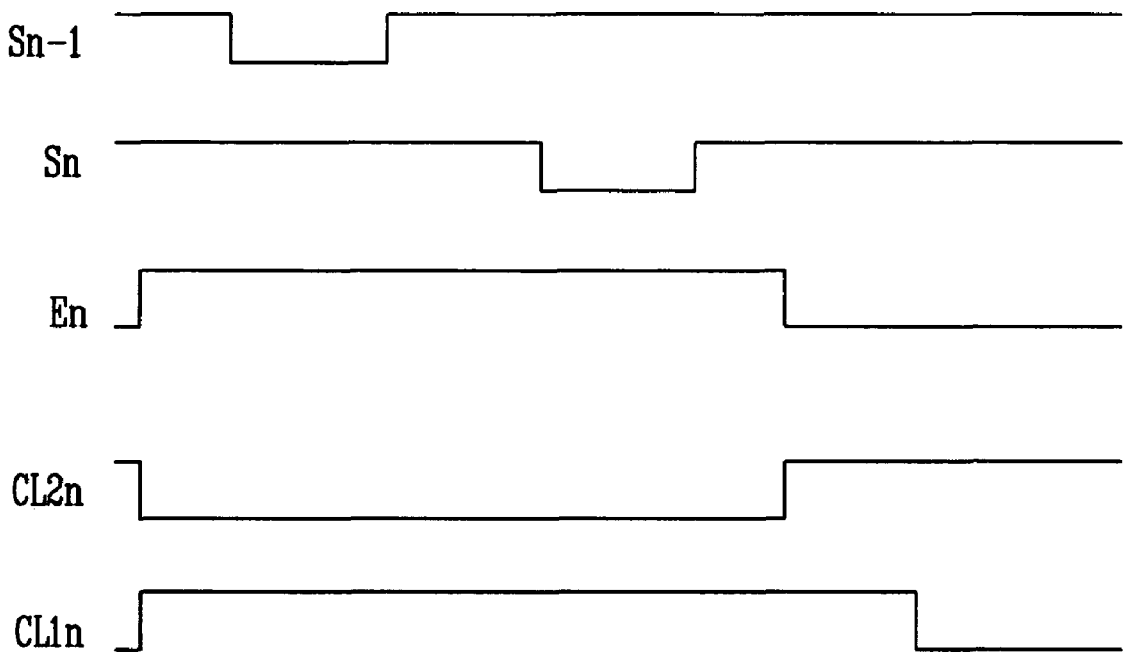
FIG. 4 illustrates a waveform diagram for use in driving the pixel shown in FIG. 3.

FIG. 4 illustrates a waveform diagram for driving the pixel 240*a* shown in FIG. 3.

With reference to FIG. 3 and FIG. 4, when a low scan signal is supplied to the (n−1)-th scan line Sn−1, the fourth transistor M4 is turned-on. When the fourth transistor M4 is turned-on, a voltage of the voltage source Vsus is supplied to the first node N1. That is, while a low scan signal is supplied to the (n−1)-th scan line Sn−1, a voltage of the first node N1 is initialized with a voltage of the voltage source Vsus. The voltage of the voltage source Vsus may be set to a value lower than that of the data signal Data.

When a high emission control signal is supplied to the emission control En, the fifth transistor M5 and the sixth transistor M6 are turned-off. When a high first control signal is supplied to the first control line CL1*n*, the eighth transistor M8 is turned-off. When a low second control signal is supplied to the second control line CL2*n*, the seventh transistor M7 is turned-on. When the seventh transistor M7 is turned-on, the voltage Voled of the OLED is supplied to the second node N2. When the sixth transistor M6 is turned-off, the voltage Voled of the OLED is set to a threshold voltage of the OLED.

When a low scan signal is supplied to the n-th scan line Sn, the first transistor M1 and the third transistor M3 are turned-on. When the third transistor M3 is turned-on, the second transistor M2 is diode-connected. When the first transistor M1 is turned-on, the data signal Data supplied to the data line Dm is provided to the first electrode of the second transistor M2 through the first transistor M1. When a voltage of the first node N1 is set to be lower than that of the data signal Data, the data signal Data is supplied to the first node N1 through the second transistor M2 and the third transistor M3. Since the data signal Data is supplied to the first node N1 through the diode-connected second transistor M2, the storage capacitor Cst is charged with a voltage corresponding to the data signal Data and a threshold voltage of the second transistor M2.

When a high scan signal is supplied to the n-th scan line Sn, the first transistor M1 and the third transistor M3 are turned-off. When a high second control signal is supplied, the seventh transistor M7 is turned-off. Accordingly, the OLED is electrically isolated from the second node N2. Consequently, the second node N2 maintains the threshold voltage of the OLED. When supply of the high emission control signal stops, i.e., the emission control signal transitions low, the fifth transistor M5 and the sixth transistor M6 are turned-on.

When the fifth transistor M5 and the sixth transistor M6 are turned-on, the first power source ELVDD, the second transistor M2, and the OLED are electrically connected to each other. Accordingly, the second transistor M2 supplies an electric current corresponding to a voltage applied to the first node N1 to the OLED.

When a low first control signal is supplied, the eighth transistor M8 is turned-on. When the eighth transistor M8 is turned-on, a voltage of the second node N2 decreases to a voltage of the voltage source Vsus. At this time, the gate voltage of the second transistor M2, i.e., a voltage of the first node N1, also decreases corresponding to a voltage decrease of the second node N2. Further, the second transistor M2 supplies an electric current corresponding to the dropped voltage to the OLED.

As time goes by, the OLED may degrade. As the OLED degrades, a voltage applied to the OLED increases. Accordingly, as the OLED degrades, a voltage drop, i.e., the difference between Vsus and Voled, at the second node N2 increases. In other words, as the OLED degrades, the voltage Voled of the OLED supplied to the second node N2 increases. Accordingly, the voltage drop at the second node N2 increases when the OLED degrades.

When the voltage drop at the second node N2 increases, a voltage drop at the first node N1 increases. Accordingly, an amount of an electric current supplied to the OLED from the second transistor M2 increases for the same data signal Data. Thus, in embodiments, as the OLED degrades, the electric current supplied to the OLED from the second transistor M2 increases. Accordingly, luminance deterioration due to degradation of the OLED may be compensated. Further, embodiments may control a duration of supply of the electric current from the second transistor M2 corresponding to the first node to the OLED, allowing a degree of compensation according to the degradation of the OLED to be controlled.

In other words, while a high first control signal is supplied to the first control line CL1*n*, the degradation of the OLED is not compensated. When a low first control signal is supplied to the first control line CL1*n* is supplied, the degradation of the OLED is compensated. Thus, in accordance with an embodiment, luminance of the OLED may be controlled by controlling the first control signal supplied to the first control line CL1*n*. In other words, by supplying low first control signal for a longer time, the luminance of the OLED may be increased.

Figure 5:
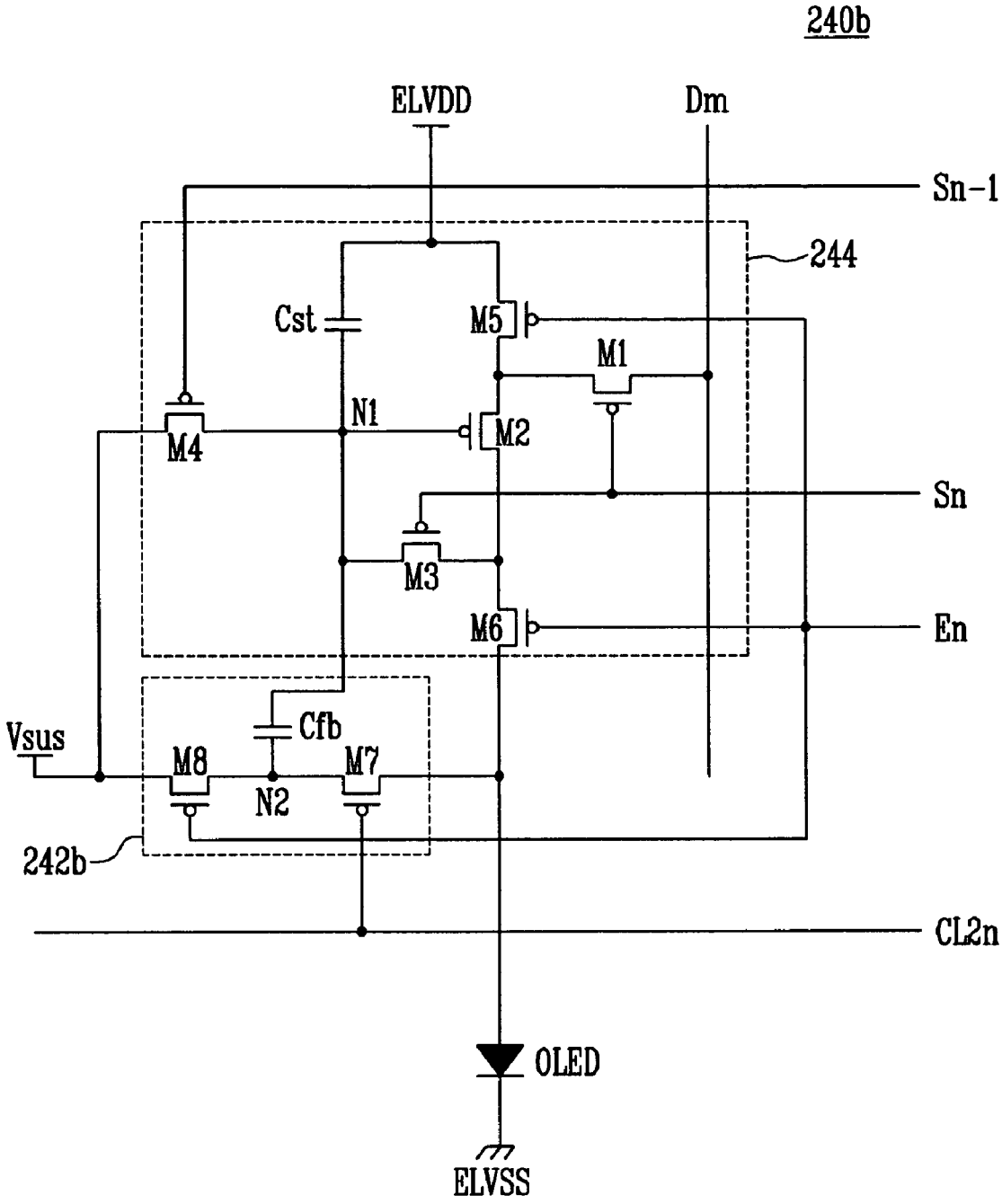
FIG. 5 illustrates a detailed circuit diagram of the compensator shown in FIG. 2 according to an embodiment.

FIG. 5 illustrates a pixel 240*b* including a compensator 242*b* for use as the pixel 240' shown in FIG. 2. A description of elements of the compensator 242*b* shown in FIG. 5 that are the same as the embodiment shown in FIG. 3 will be omitted.

With reference to FIG. 5, the compensator 242*b* may include the seventh transistor M7, the eighth transistor M8, and the feedback capacitor Cfb. The seventh transistor M7 and the eighth transistor M8 may be coupled between the voltage source Vsus and the anode electrode of the OLED. The feedback capacitor Cfb may be coupled between the first node N1 and the second node N2.

The seventh transistor M7 may be coupled between the second node N2 and the OLED. The seventh transistor M7 may be controlled by the second control signal supplied to the second control line CL2*n*. For example, when a low second control signal is supplied, the seventh transistor M7 is turned-on. Otherwise, the seventh transistor M7 is turned-off.

The eighth transistor M8 may be coupled between the second node N2 and the voltage source Vsus. The eighth transistor M8 may be controlled by the emission control signal supplied to the emission control line En. For example, when a low emission control signal is supplied, the eighth transistor M8 is turned-on. Otherwise, the eighth transistor M8 is turned-off.

The compensator 242*b* may have substantially the same functions and construction as the compensator 242*a*, except the eighth transistor M8 is coupled to the emission control line En. Accordingly, in the pixel 240*b*, the first control line CL1*n* may be removed.

Figure 6:
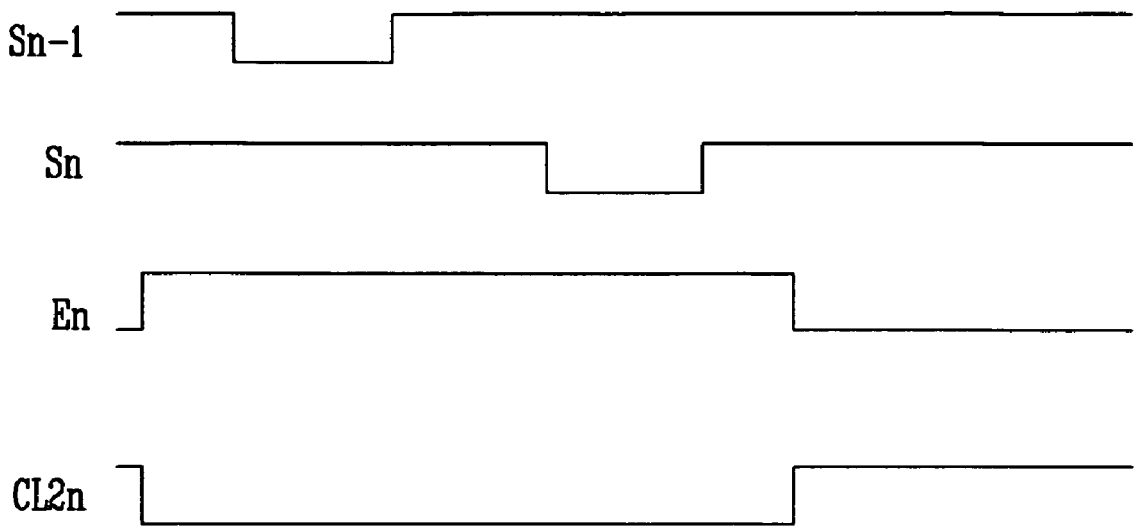
FIG. 6 illustrates a waveform diagram for use in driving the pixel shown in FIG. 5.

FIG. 6 illustrates a waveform diagram for use in driving the pixel 240*b* shown in FIG. 5.

With reference to FIG. 5 and FIG. 6, a low scan signal supplied to an (n−1)-th scan line Sn−1 turns-on the fourth transistor M4. When the fourth transistor M4 is turned-on, a voltage of the voltage source Vsus is supplied to the first node N1. Accordingly, the first node N1 is initialized with a voltage of the voltage source Vsus.

When a high emission control signal is supplied to the emission control line En, the fifth transistor M5, the sixth transistor M6, and the eighth transistor M8 are turned-off. When a low second control signal is supplied to the second control line CL2*n*, the seventh transistor M7 is turned-on. When the seventh transistor M7 is turned-on, the voltage Voled of the OLED is supplied to the second node N2.

When a low scan signal is supplied to the n-th scan line Sn, the first transistor M1 and the third transistor M3 are turned-on. When the third transistor M3 is turned-on, the second transistor M2 is diode-connected. When the first transistor M1 and the third transistor M3 are turned-on, the data signal Data supplied to the data line Dm is provided to the first node N1. At this time, the storage capacitor Cst is charged with a voltage corresponding to the data signal Data and a threshold voltage of the second transistor M2.

When a high scan signal is supplied to the n-th scan line Sn, the first transistor M1 and the third transistor M3 are turned-off. When a high second control signal is supplied, the seventh transistor M7 is turned-off. When a low emission control signal is supplied, the fifth transistor M5, the sixth transistor M6, and the eighth transistor M8 are turned-on. When the eighth transistor M8 is turned-on, a voltage of the second node N2 drops from a voltage of the OLED to a voltage of the voltage source Vsus. A voltage of the first node N1 also drops corresponding to a voltage drop of the second node N2. Since the voltage drop in the first node N1 corresponds to a degradation degree of the OLED, the degradation of the OLED may be compensated.

Meanwhile, because the fifth transistor M5 and the sixth transistor M6 are turned-on, the second transistor M2 controls an amount of an electric current supplied to the OLED corresponding to a voltage applied to the first node N1. The OLED generates light of predetermined luminance corresponding to the electric current supplied from the second transistor M2.

Figure 7:
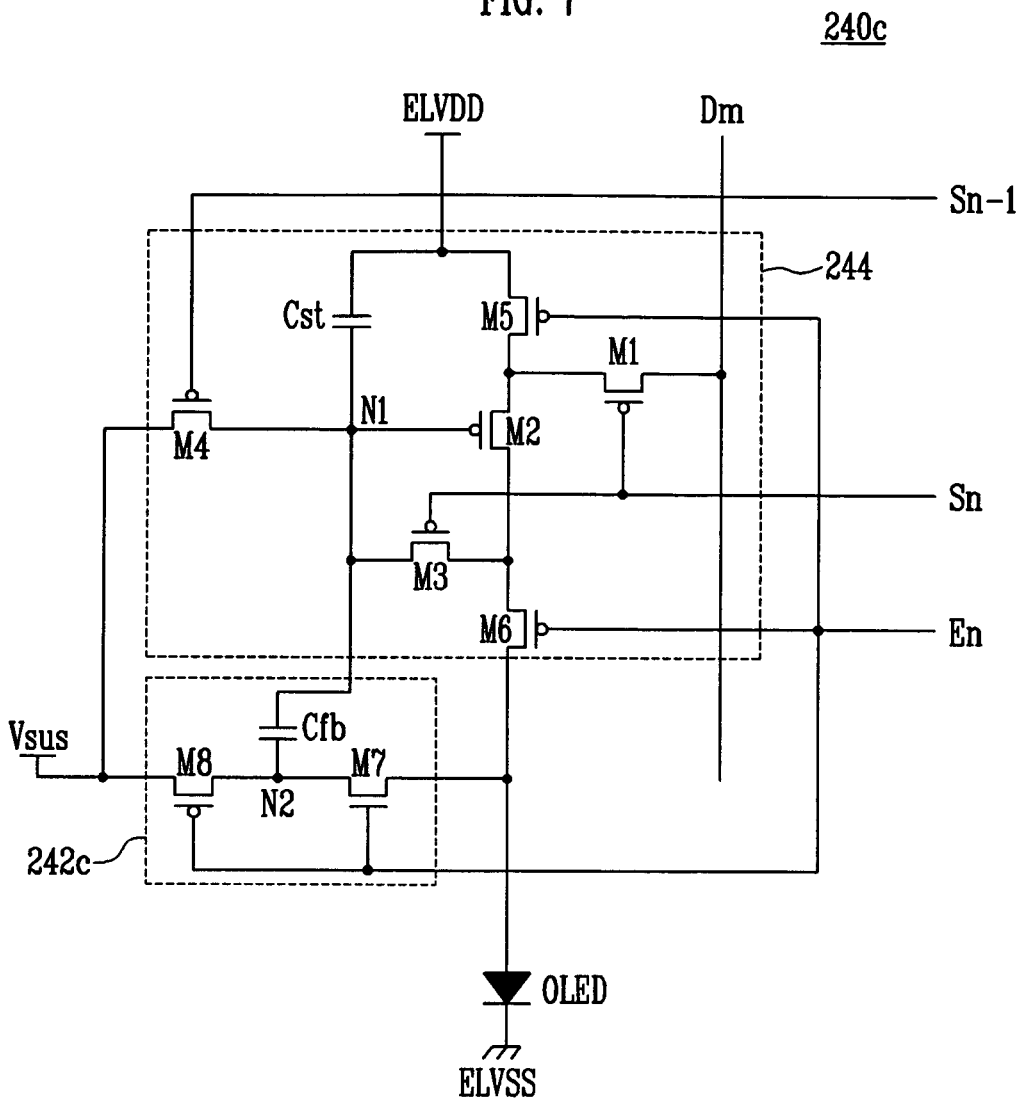
FIG. 7 illustrates a detailed circuit diagram of the compensator shown in FIG. 2 according to an embodiment.

FIG. 7 illustrates a pixel 240*c* having a compensator 242*c* for use as the pixel 240' shown in FIG. 2. A description of the elements of the compensator 242*c* shown in FIG. 7 that are the same as that of the compensator 242*a* shown in FIG. 3 will not be repeated.

With reference to FIG. 7, the compensator 242*c* may include a seventh transistor M7', the eighth transistor M8, and the feedback capacitor Cfb. The seventh transistor M7' and the eighth transistor M8 may be coupled between the voltage source Vsus and the anode electrode of the OLED. The feedback capacitor Cfb may be coupled between the first node N1 and the second node N2.

The seventh transistor M7' may be coupled between the second node N2 and the OLED. The seventh transistor M7' may be controlled by an emission control signal supplied to the emission control line En. For example, when a high emission control signal is supplied, the seventh transistor is turned-on. Otherwise, the seventh transistor M7' is turned-off. The seventh transistor M7' may have a conductivity type different from that of the transistors M1 to M6, e.g., may be an NMOS transistor.

The eighth transistor M8 may be coupled between the second node N2 and the voltage source Vsus. The eighth transistor M8 may be controlled by the emission control signal supplied to the emission control line En. For example, when a high emission control signal is supplied, the eighth transistor M8 is turned-off. Otherwise, the eighth transistor M8 is turned-on. The eighth transistor M8 may have the same conductivity type than that of the transistors M1 to M6, e.g., may be a PMOS transistor.

Thus, the compensator 242*c* may have substantially the same functions and construction as those the compensator 242*a*, except that the seventh transistor M7' and the eighth transistor M8 may have different conductivity types, and the seventh transistor M7' and the eighth transistor M8 are coupled to the emission control line En. Accordingly, in the pixel 242*c*, the first control line CL1*n* and the second control line CL2*n* may be omitted.

Figure 8:
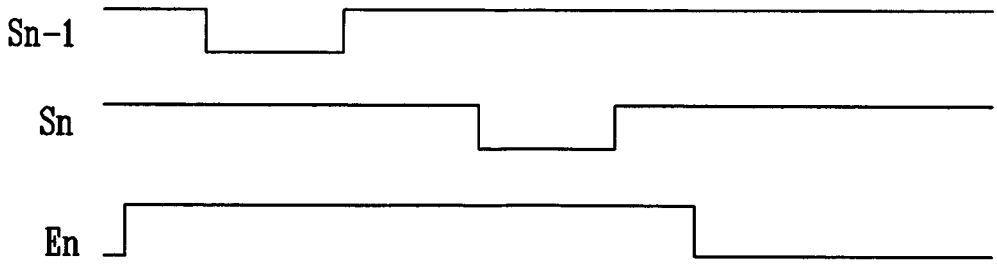
FIG. 8 illustrates a waveform diagram for use in driving the pixel shown in FIG. 7.

FIG. 8 illustrates a waveform diagram for use in driving the pixel 240*c* shown in FIG. 7.

With reference to FIG. 7 and FIG. 8, when a low scan signal is supplied to an (n−1)-th scan line Sn−1, the fourth transistor M4 is turned-on. When the fourth transistor M4 is turned-on, a voltage of the voltage source Vsus is supplied to the first node N1. Accordingly, the first node N1 is initialized with a voltage of the voltage source Vsus.

When a high emission control signal is supplied to the emission control En, the fifth transistor M5, the sixth transistor M6, and the eighth transistor M8 are turned-off, whereas the seventh transistor M7' is turned-on. When the seventh transistor M7' is turned-on, a voltage of the OLED is supplied to the second node N2.

During supply of the high emission control signal to the emission control line En, a low scan signal is supplied to the n-th scan line Sn to turn-on the first transistor M1 and the third transistor M3. When the third transistor M3 is turned-on, the second transistor M2 is diode-connected. When the first transistor M1 and the third transistor M3 are turned-on, the data signal Data supplied to the data line Dm is provided to the first node N1. At this time, the storage capacitor Cst is charged with a voltage corresponding to the data signal and a threshold voltage of the second transistor M2.

Next, a high scan signal and a low emission control signal may be sequentially supplied. When a high scan signal is supplied, the first transistor M1 and the third transistor M3 are turned-off. When a low emission control signal is supplied, the fifth transistor M5, the sixth transistor M6, and the eighth transistor M8 are turned-on, but the seventh transistor M7' is turned-off. When the eighth transistor M8 is turned-on, a voltage of the second node N2 drops from a voltage of the OLED to a voltage of the voltage source Vsus. At this time, a voltage of the first node N1 also drops corresponding to a voltage drop of the second node N2. Since a voltage drop in the first node N1 corresponds to a degradation degree of the OLED, the degradation of the OLED may be compensated.

Since the fifth transistor M5 and the sixth transistor M6 are turned-on, the second transistor M2 controls an amount of an electric current supplied to the OLED corresponding to a voltage applied to the first node N1. The OLED generates light of predetermined luminance corresponding to the electric current supplied from the second transistor M2.

Figure 9:
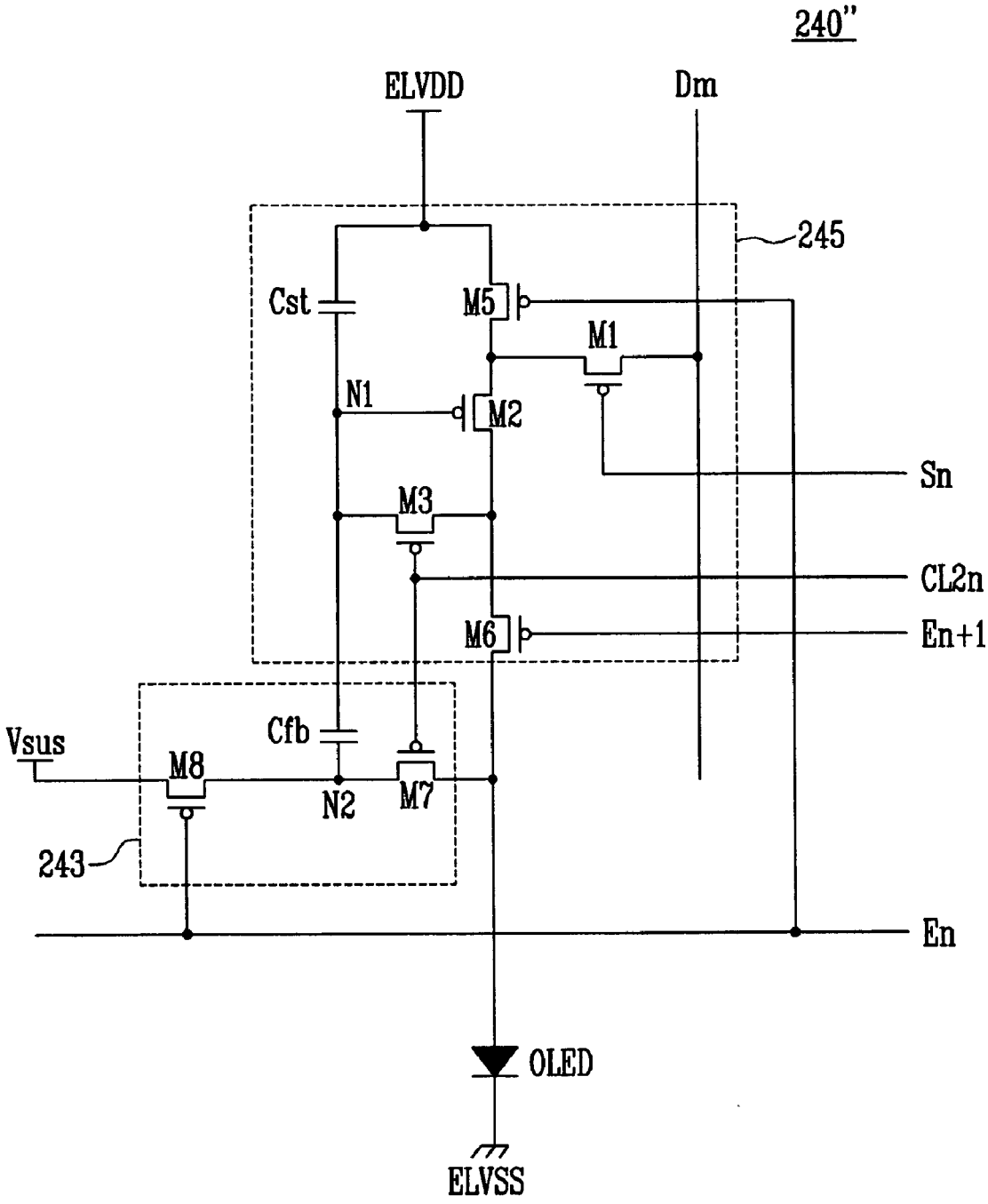
FIG. 9 illustrates a circuit diagram of an embodiment of the pixel shown in FIG. 1.

FIG. 9 illustrates a circuit diagram of a pixel 240" for use as the pixel 240 shown in FIG. 1. Construction of the pixel 240" shown in FIG. 9 that is the same as the pixel 240' shown in FIG. 2 will not be described. With reference to FIG. 9, the pixel 240" may include a compensator 243 and a pixel circuit 245.

The pixel circuit 245 may include first to sixth transistors M1 to M6. The third transistor M3 may be coupled between the gate electrode and the second electrode of the second transistor M2, and may diode-connect the second transistor M2. When a low second control signal is supplied to a second control line CL2*n*, the third transistor M3 is turned-on. Otherwise, the third transistor M3 is turned-off.

The sixth transistor M6 may be coupled between the second transistor M2 and the OLED. When a high emission control signal is supplied to an (n+1)-th emission control line En+1, the sixth transistor M6 is turned-off. Otherwise, the sixth transistor M6 is turned-on.

The compensator 243 may include the seventh transistor M7 and the eighth transistor M8. The seventh transistor M7 may be coupled with the second node N2 and the OLED. When a low second control signal is supplied to a second control line CL2*n*, the seventh transistor M7 is turned-on. Otherwise, the seventh transistor M7 is turned-off. The eighth transistor M8 may be coupled between the second node N2 and the voltage source Vsus. When a high emission control signal is supplied to the emission control line En, the eighth transistor M8 is turned-off. Otherwise, the eighth transistor M8 is turned-on.

Furthermore, in another embodiment of the present invention, a voltage of the voltage source Vsus may be set to be higher or lower than a voltage of the OLED. A detailed description thereof will be provided below.

Figure 10:
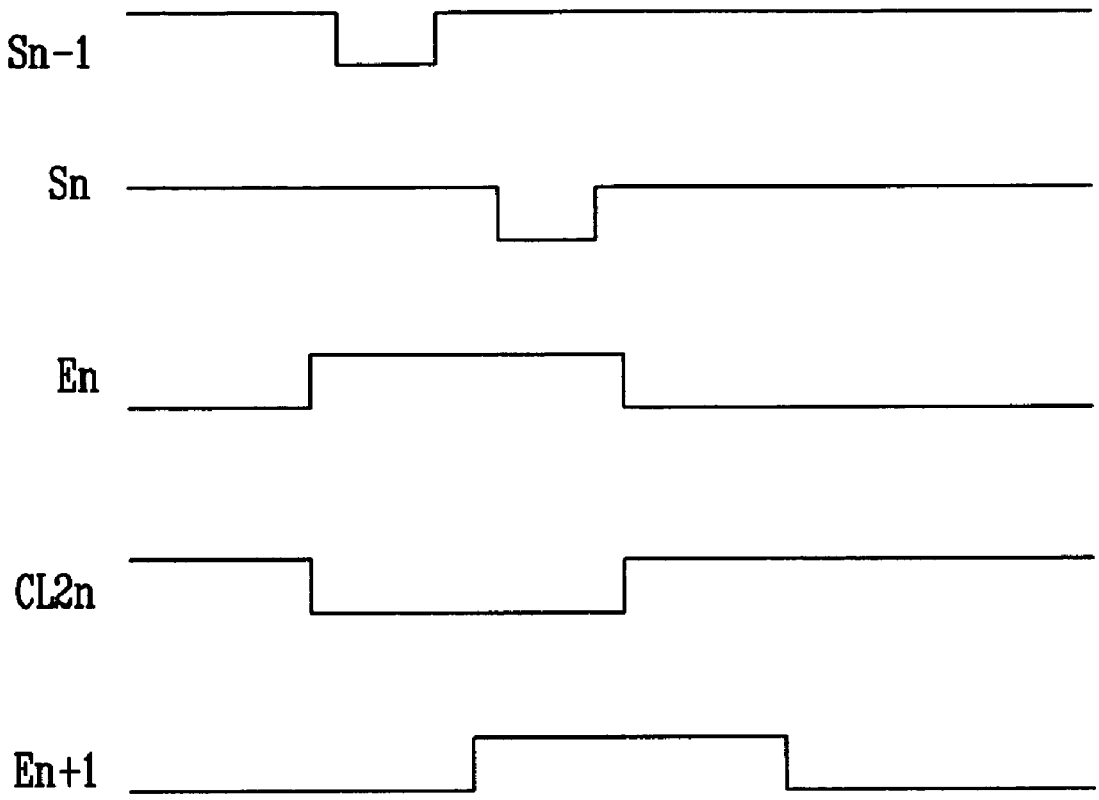
FIG. 10 illustrates a waveform diagram for use in driving the pixel shown in FIG. 9.

FIG. 10 illustrates a waveform diagram for use in driving the pixel 240" shown in FIG. 9.

Referring to FIG. 9 and FIG. 10, first, a high emission control signal is supplied to the emission control line En and a low second control signal is supplied to the second control line CL2*n*. When a high emission control signal is supplied, the fifth transistor M5 and the eighth transistor M8 are turned-off. When a low second control signal is supplied, the third transistor M3 and the seventh transistor M7 are turned-on.

When the third transistor M3 is turned-on, the first node N1 is electrically connected to the second power source ELVSS through the third transistor M3, the sixth transistor M6, and the OLED. In this case, the first node N1 is initialized with a voltage of the second power source ELVSS. In practice, the first node N1 is initialized with a voltage slightly greater than a voltage of the second power source ELVSS. Since the fifth transistor M5 is turned-off, the OLED generates weak light that does not influence an image to be displayed.

Then, a high emission control signal is supplied to the (n+1)-th control line En+1, and a low scan signal is supplied to the scan line Sn. When a high emission control signal is supplied to the (n+1)-th control line En+1, the sixth transistor M6 is turned-off. At this time, since the seventh transistor M7 remains turned-on, the second node N2 is set to a threshold voltage of the OLED.

When the low scan signal is supplied to the scan line Sn, the first transistor M1 is turned-on. When the first transistor M1 is turned-on, the data signal Data supplied to the data line Dm is provided to the first node N1. At this time, the storage capacitor Cst is charged with an electric current corresponding to the data signal and the threshold voltage of the OLED.

After the storage capacitor Cst is charged with a predetermined voltage, the emission control signal transitions low and the second control signal transitions high. When a high scan signal is supplied to the scan line Sn, the first transistor M1 is turned-off. When supply of the second control signal stops, the third transistor M3 and the seventh transistor M7 are turned-off.

When a low emission control signal is supplied to the emission control line En stops, the eighth transistor M8 is turned-on. When the eighth transistor M8 is turned-on, a voltage of the second node N2 decreases or increases to a voltage of the voltage source Vsus.

As described above, when the voltage of the voltage source Vsus is less than the threshold voltage of the OLED, the degradation of the OLED may be compensated. Alternatively, when the voltage of the voltage source Vsus is greater than the threshold voltage of the OLED, the degradation of the OLED may be compensated.

For example, when the voltage of the voltage source Vsus is set to 5V, and an initial threshold voltage of the OLED is 1V, a voltage rise of a voltage in the second node N2 is 4V. The voltage of the first node N1 also increases by 4V. When the OLED degrades, e.g., to a threshold voltage of 2V, the voltage rise of the second node N2 is 3V, i.e., the voltage rise decreases. The voltage rise of the first node N1 also corresponds to the voltage rise of the second node N2. Thus, as the OLED degrades, the voltage rise of the first node N1 decreases. Accordingly, as the OLED degrades, more electric current may be supplied to the OLED.

After a voltage of the first node N1 is increased or reduced in accordance with a voltage of the voltage source Vsus, a low emission control signal is supplied to the (n+1)-th emission control line En+1 to turn-on the sixth transistor M6. Accordingly, the second transistor M2 supplies an electric current corresponding to a voltage applied to the first node N1 to the OLED.

Figure 11:
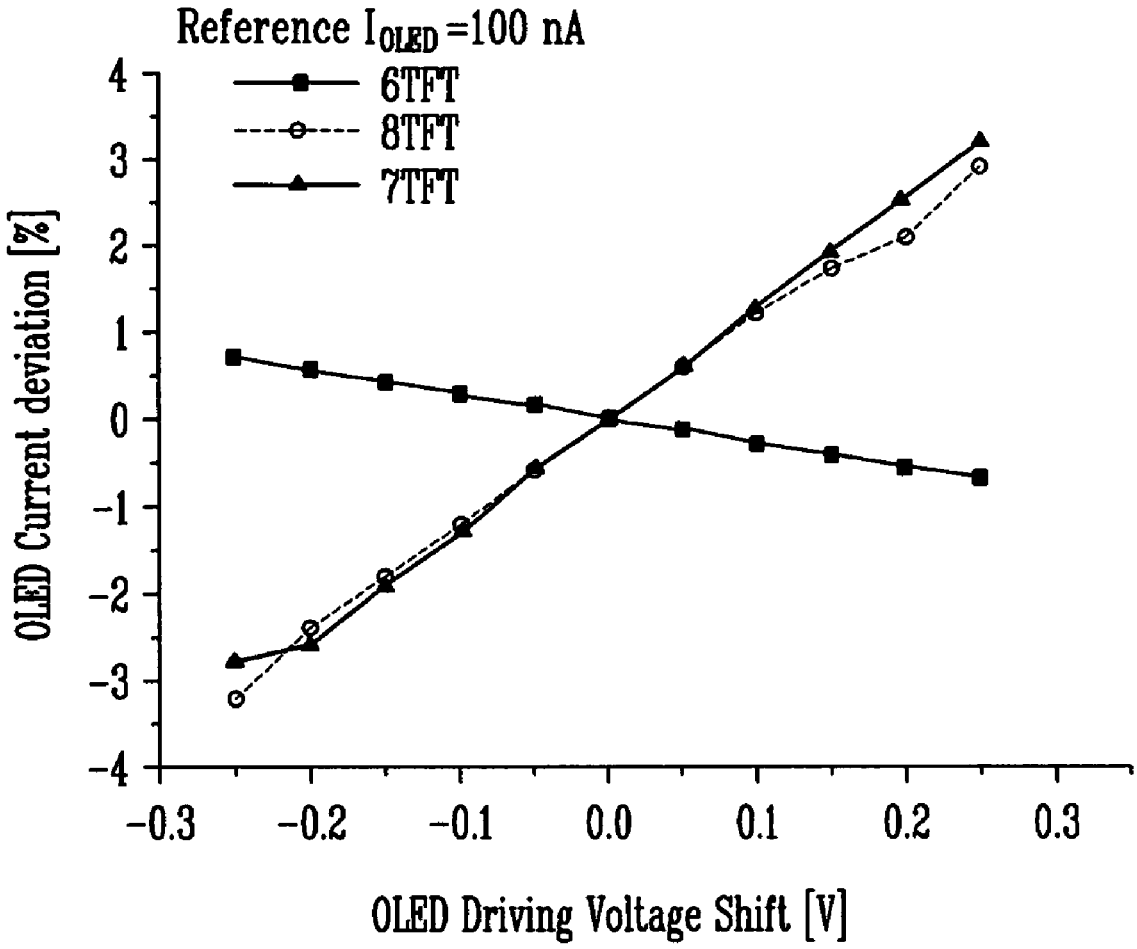
FIG. 11 illustrates a graph of a simulation result of a pixel according to an embodiment.

FIG. 11 illustrates a comparison of a pixel without a compensation circuit and with a compensation circuit according to embodiments. In FIG. 11, 6TFT indicates the pixel 240' shown in FIG. 2 without the compensator 242, 8TFT indicates the pixel 240*a* shown in FIG. 4, and 7TFT indicates the pixel 240" shown in FIG. 9. In FIG. 11, a Y-axis indicates a percentage deviation of an electric current flowing to the OLED and an X-axis indicates a change of a threshold voltage corresponding to a degradation of the OLED.

With reference to FIG. 11, when the pixel 240' does not include the compensator 242, electric current flowing to the OLED as the OLED degrades is decreased. However, according to embodiments, electric current flowing to the OLED increases as the OLED degrades.

As described above, in the pixel, the organic light emitting display, and a driving method thereof, a voltage of the gate electrode in a drive transistor may be controlled corresponding to the degradation of an OLED is degraded, thereby compensating the degradation of the OLED. Furthermore, since embodiments may compensate a threshold voltage of the drive transistor, images having adequate luminance may be displayed regardless of a deviation of the threshold voltage.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A pixel, comprising:

an organic light emitting diode;

a drive transistor configured to supply an electric current to the organic light emitting diode;

a pixel circuit configured to compensate a threshold voltage of the drive transistor, the pixel circuit includes a storage capacitor and is configured to diode-connect the drive transistor when a low scan signal is supplied to charge the storage capacitor with a voltage corresponding to a data signal and the threshold voltage of the drive transistor; and a compensator configured to control a voltage of a gate electrode of the drive transistor to compensate for a degradation of the organic light emitting diode, wherein the compensator includes a feedback capacitor having a first terminal coupled with the gate electrode of the drive transistor and a second terminal coupled to a common node of a first compensator transistor and a second compensator transistor, the first compensator transistor and the second compensator transistor between a voltage source and an anode electrode of the organic light emitting diode, and the compensator is configured to maintain the second terminal of the feedback capacitor at a threshold voltage of the organic light emitting diode while the storage capacitor is charged with the voltage.

2. The pixel as claimed in claim 1, wherein a voltage of the voltage source is set to be lower than the threshold voltage of the organic light emitting diode.

3. The pixel as claimed in claim 1, wherein the first compensator transistor and the second compensator transistor are alternately turned-on/off.

4. The pixel as claimed in claim 3, wherein a high emission control signal supplied to an i-th emission control line overlaps a low scan signal supplied to the (i−1)-th scan line and the i-th scan line.

5. The pixel as claimed in claim 4, wherein:

the first compensator transistor is turned-on to supply the threshold voltage of the organic light emitting diode to the common node when a low second control signal is supplied to a second control line; and the second compensator transistor is turned-on to change a voltage of the common node to the voltage of the voltage source when a low first control signal is supplied to a first control line.

6. The pixel as claimed in claim 5, wherein a high first control signal and the low second control signal supplied from the first and second i-th control lines, respectively, overlap with a high emission control signal supplied to the i-th emission control line.

7. The pixel as claimed in claim 4, wherein:

the first compensator transistor is turned-on to supply the threshold voltage of the organic light emitting diode to the common node when a low second control signal is supplied to a second control line; and the second compensator transistor is turned-on to change a voltage of the common node to the voltage of the voltage source when a low emission control signal is supplied to the i-th emission control line.

8. The pixel as claimed in claim 7, wherein the low second control signal supplied to an i-th second control line overlaps the high emission control signal supplied to the i-th emission control line.

9. The pixel as claimed in claim 4, wherein:

the first compensator transistor is turned-on to supply the threshold voltage of the organic light emitting diode to the common node when a low emission control signal is supplied to the i-th emission control line; and the second compensator transistor is turned-on to change a voltage of the common node to the voltage of the voltage source when a low emission control signal is supplied to the i-th emission control line.

10. The pixel as claimed in claim 4, wherein a low second control signal supplied from a i-th second control line overlaps the high emission control signal supplied to the i-th emission control line.

11. The pixel as claimed in claim 1, wherein the drive transistor is a second transistor in the pixel circuit, the pixel circuit comprising:

a first transistor coupled to i-th scan and data lines, and being turned-on when the low scan signal is supplied to the i-th scan line to provide the data signal supplied to the data line to a first electrode of the second transistor;

a third transistor coupled between a second electrode and a gate electrode of the second transistor, and being turned-on when the low scan signal is supplied to the i-th scan line;

a fourth transistor coupled between the voltage source and the gate electrode of the second transistor, and being turned-on when the low scan signal is supplied to an (i−1)-th scan line;

a fifth transistor coupled between the second transistor and a first power source, and being turned-on when a low emission control signal is supplied to an emission control line; and a sixth transistor coupled between the second transistor and the organic light emitting diode, and being turned-on when the low emission control signal is supplied to the emission control line, wherein the storage capacitor is coupled between the first power source and the gate electrode of the second transistor.

12. The pixel as claimed in claim 1, wherein the drive transistor is a second transistor in the pixel circuit, the pixel circuit comprising:

a first transistor coupled to a scan line and a data line, and being turned-on to supply the data signal supplied to the data line to a first electrode of the second transistor when the low scan signal is supplied to the scan line;

a third transistor coupled between a second electrode and the gate electrode of the second transistor, and being turned-on when a low second control signal is supplied to a second control line;

a fourth transistor coupled between the second transistor and a first power source, and being turned-on when a low emission control signal is supplied to an i-th emission control line; and a fifth transistor coupled between the second transistor and the organic light emitting diode, and being turned-on when the low emission control signal is supplied to an (i+1)-th emission control line, wherein the storage capacitor coupled between the first power source and the gate electrode of the second transistor.

13. An organic light emitting display, comprising:

a scan driver configured to drive scan lines;

a data driver configured to drive data lines; and pixels coupled with the scan lines and the data lines, wherein each of the pixels includes:

an organic light emitting diode;

a drive transistor configured to supply an electric current to the organic light emitting diode;

a pixel circuit configured to compensate a threshold voltage of the drive transistor, the pixel circuit includes a storage capacitor and is configured to diode-connect the drive transistor when a low scan signal is supplied to charge the storage capacitor with a voltage corresponding to a data signal and the threshold voltage of the drive transistor; and a compensator configured to control a voltage of a gate electrode of the drive transistor in order to compensate a degradation of the organic light emitting diode, wherein the compensator includes a feedback capacitor having a first terminal coupled with the gate electrode of the drive transistor and a second terminal coupled to a common node of a first compensator transistor and a second compensator transistor, the first compensator transistor and the second compensator transistor between a voltage source and an anode electrode of the organic light emitting diode, and the compensator is configured to maintain the second terminal of the feedback capacitor at a threshold voltage of the organic light emitting diode while the storage capacitor is charged with the voltage.

14. A method for driving an organic light emitting display, comprising:

diode-connecting a drive transistor when a low scan signal is supplied to charge a storage capacitor with a voltage corresponding to a data signal and a threshold voltage of the drive transistor;

maintaining a second terminal of a feedback capacitor at a threshold voltage of the organic light emitting diode while the storage capacitor is charged, a first terminal of the feedback capacitor being coupled with a gate electrode of the drive transistor, the second terminal coupled to a common node of a first compensator transistor and a second compensator transistor, the first compensator transistor and the second compensator transistor between a voltage source and an anode electrode of an organic light emitting diode; and changing a voltage at the second terminal of the feedback capacitor to a voltage of the voltage source after the storage capacitor is charged.

15. The method as claimed in claim 14, further comprising supplying the voltage of the voltage source to the gate electrode of the drive transistor prior to supplying the low scan signal.

16. The method as claimed in claim 14, wherein the voltage of the voltage source is lower than the threshold voltage of the organic light emitting diode.

17. The method as claimed in claim 14, wherein the voltage of the voltage source higher than the threshold voltage of the organic light emitting diode.

* * * * *